US008752837B2

(12) United States Patent
Iwata et al.

(10) Patent No.: US 8,752,837 B2
(45) Date of Patent: Jun. 17, 2014

(54) SHEET STORAGE DEVICE AND IMAGE FORMING APPARATUS

(75) Inventors: Toshiyuki Iwata, Abiko (JP); Daisaku Kamiya, Abiko (JP); Hideki Kushida, Moriya (JP); Naoto Tokuma, Abiko (JP); Toshiki Momoka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/484,697

(22) Filed: May 31, 2012

(65) Prior Publication Data

US 2012/0319346 A1 Dec. 20, 2012

(30) Foreign Application Priority Data

Jun. 15, 2011 (JP) ..... 2011-133568

(51) Int. Cl.
*B65H 39/10* (2006.01)

(52) U.S. Cl.
USPC ..... 271/292; 271/299; 271/212

(58) Field of Classification Search
USPC ..... 271/287, 292–295, 298, 299, 212, 181, 271/81, 177, 178, 180
See application file for complete search history.

(56) References Cited

U.S. PATENT DOCUMENTS 5,331,389 A * 7/1994 Fukuchi et al. ..... 399/403
5,722,030 A 2/1998 Kato
6,227,539 B1 * 5/2001 Ferrara ..... 271/293
6,647,243 B2 11/2003 Sato et al.
6,994,339 B2 2/2006 Kato et al.
7,050,752 B2 5/2006 Sato et al.
7,874,553 B2 1/2011 Kushida et al.
7,922,165 B2 4/2011 Kamiya
8,146,904 B2 4/2012 Watanabe et al.
8,172,224 B2 5/2012 Kushida
2012/0275839 A1 * 11/2012 Kushida et al. ..... 400/623
2012/0288310 A1 * 11/2012 Kamiya et al. ..... 399/381
2012/0313313 A1 * 12/2012 Momoka et al. ..... 271/3.19
2012/0313317 A1 * 12/2012 Gamo et al. ..... 271/225
2012/0319346 A1 * 12/2012 Iwata et al. ..... 271/3.14

FOREIGN PATENT DOCUMENTS

JP 8-048458 A 2/1996
JP 3535573 B 6/2004

* cited by examiner

*Primary Examiner* — Michael McCullough

(74) *Attorney, Agent, or Firm* — Fitzpatrick, Cella, Harper & Scinto

(57) ABSTRACT

A sheet storage device is equipped with sheet storage portions which are provided in an upper portion of a copying machine body and receive sheets, conveyed in sequence from the copying machine body, from downward and store the sheets in such a state that the sheets stand. The sheet storage portions are relatively rotatably supported in sequence and parallel. Each sheet storage portion receiving the sheet from the copying machine body is rotated to be held in the rotational position.

12 Claims, 14 Drawing Sheets

SHEET STORAGE DEVICE AND IMAGE FORMING APPARATUS

BACKGROUND OF THE INVENTION

1. Field of the Invention

The present invention relates to a sheet storage device, which is equipped with a plurality of sheet storage portions holding sheets in a substantially vertical direction, and an image forming apparatus equipped with the sheet storage device.

2. Description of the Related Art

In the prior art, as a sheet storage device provided in this type of image forming apparatus, there has been known a bin movable type sorter movably equipped with a plurality of bin trays (stack trays) capable of storing sheets discharged after image formation thereon (see, Japanese Patent Laid-Open No. 8-048458). In addition to this, there has been known a bin fixed type sorter in which a sheet conveying portion moves relative to each bin tray of a plurality of fixed bin trays to selectively convey a sheet into the bin tray.

The sorter (sheet storage device) disclosed in the Japanese Patent Laid-Open No. 8-048458 is a so-called bin movable type sorter, and each of a plurality of bin trays stored in the vertical direction is moved up or down one by one by one rotation of a spiral cam provided on the both sides. A sheet formed with an image by an image forming apparatus body is conveyed to a sorting device through a discharge roller pair and selectively conveyed in a direction of a sort path or a non-sort path by a switching member (flapper) switched by rotation.

While a sheet passed through the non-sort path is discharged onto a non-sort tray, a sheet passed through the sort path is discharged by a discharge roller and placed on each bin tray lifting and lowering in synchronism with the discharge. The sheets stored on the bin tray are aligned by rotation of an alignment rod penetrating through a cut-out portion opened in each bin tray, and, according to need, staple processing is further applied to the sheets by an electric stapler. When a user takes out an output sheet, all the bin trays are simultaneously drawn out on the near side by the rotation of the alignment rod.

However, in order to sort sheets, the above conventional sheet storage device is configured so that the bin trays are stacked and arranged in the vertical direction, and the bin tray onto which a sheet is discharged is changed for each job of a discharged sheet. In the sort device, there is a height difference in a position of each bin tray, and visibility and taking-out property of sheets placed on lower bin trays are not particularly good. Since all the bin trays are drawn out on the near side when a sheet is taken out, the visibility of sheets placed on the bin trays other than the uppermost bin tray is not good.

The above conventional sheet storage device is disposed in a horizontal downstream direction (width direction) relative to a discharge portion of an image forming apparatus. Thus, the device size in the width direction of the entire system including the image forming apparatus and a sheet loading device is required to be further increased by the conveying direction length of the size of a sheet to be discharged with respect to a discharge portion of the image forming apparatus.

The present invention provides a sheet storage device, which can enhance a sheet taking-out property in taking out of a sheet from a stack tray and visibility of a sheet, and an image forming apparatus equipped with the sheet storage device.

SUMMARY OF THE INVENTION

A sheet storage device according to the present invention is equipped with a sheet conveying portion which conveys a sheet and a plurality of sheet storage portions which receives the conveyed sheet from below and stores the received sheet so that the received sheet is in a vertical state. In the sheet storage device, the sheet storage portions each have a holding portion which allows movement in a sheet conveying direction of the sheet, restricts movement of the sheet in a direction opposite to the sheet conveying direction, and holds the sheet, and the sheet storage portions are rotatably supported along a sheet surface of the sheet held by the holding portion and supported in sequence and parallel in a direction that the sheet surfaces of the sheets stored in the sheet storage portions face each other.

According to the present invention, the sheet storage portions are supported rotatably along the sheet surface of the sheet held by the holding portion and, at the same time, supported in sequence and parallel in the direction that the sheet surfaces face each other, and therefore, a height difference in the storage position can be eliminated. Since each sheet storage portion which receives the sheet from an image forming apparatus body can be rotated and held, the visibility of all the sheet storage portions can be enhanced in comparison with a conventional device, and the sheet taking-out property can be enhanced. Further, the sheet storage portions are arranged in parallel in an upper portion of the image forming apparatus body, so that the storage amount can be increased without increasing a device installation space (length in horizontal width direction) in comparison with the conventional device. Furthermore, in a method of storing the sheet storage portion, since sheets are stored in a longitudinal direction, the device installation space (length in the horizontal width direction) is not increased even if a large-size sheet is stored in the storage portion.

Further features of the present invention will become apparent from the following description of exemplary embodiments with reference to the attached drawings.

DESCRIPTION OF THE EMBODIMENTS

Figure 1:
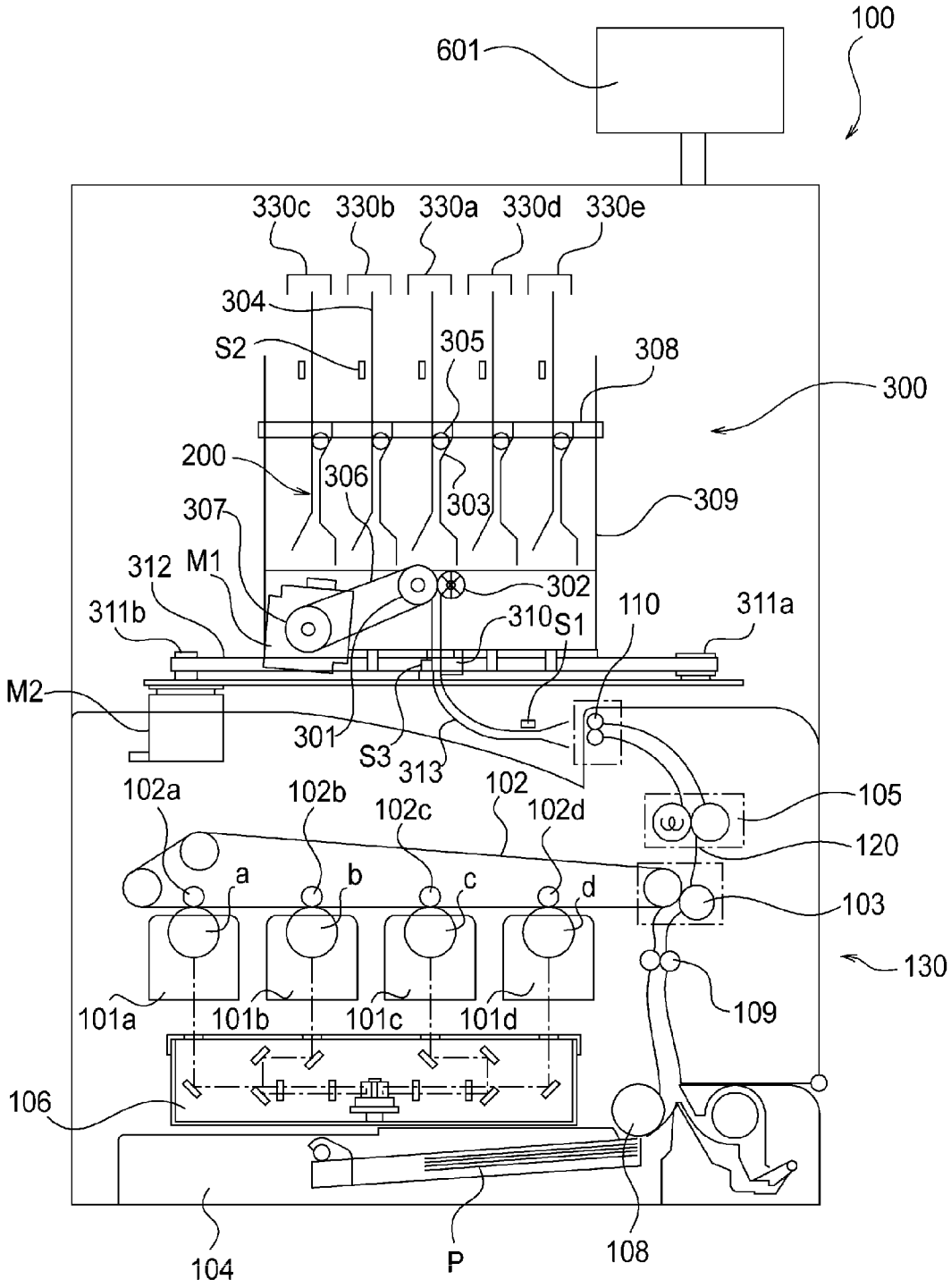
FIG. 1 is a cross-sectional view illustrating a copying machine as an image forming apparatus according to the present invention.

Hereinafter, a sheet storage device of an embodiment according to the present invention and an image forming apparatus equipped with the sheet storage device will be described with reference to FIGS. 1 to 13. Numerical values in the description are reference values and do not limit the present invention. The components designated by the same reference numerals have a similar configuration, and overlapping descriptions thereof are suitably omitted.

A color copying machine 100 which is an image forming apparatus according to the present invention will be described with reference to FIG. 1. The color copying machine 100 is provided with a copying machine body 130 which is an image forming apparatus body and a sheet storage device 300 disposed to be connected to an upper portion of the copying machine body 130. The color copying machine 100 is provided with an image forming portion to be described later, which forms an image, and sheet storage portions 330*a* to 330*e* which store a sheet P conveyed while carrying an image formed by the image forming portion. Since the sheet storage device 300 is sometimes used as an option, the copying machine body 130 may be used alone in such a state that the sheet storage device 300 is removed. Meanwhile, the sheet storage device 300 and the copying machine body 130 may be configured integrally.

[Image forming apparatus] Subsequently, the copying machine body 130 will be described. Specifically, the copying machine body 130 is provided with four photosensitive drums a (yellow), b (magenta), c (cyan), and d (black) which form toner images of each color of yellow, magenta, cyan, and black and are arranged in parallel. Those photosensitive drums a to d are driven by a motor (not shown). The copying machine body 130 is provided with an intermediate transfer belt 102 as a transfer conveying portion which is disposed at the upper portions of the photosensitive drums a to d so as to traverse longitudinally the photosensitive drums a to d.

A primary charger, a development device, and a transfer charger (not shown) are arranged around each of the photosensitive drums a to d and unitized as process cartridges 101*a* to 101*d*. An exposure device 106 constituted of a polygon mirror and so on is disposed under the photosensitive drums a to d. The image forming portion according to the present invention is constituted of the photosensitive drums a to d, transfer charge members 102*a* to 102*d* to be described later, and the intermediate transfer belt 102.

First, a laser beam according to an image signal of a yellow component color of a document is projected on the photosensitive drum a through the polygon mirror and so on of the exposure device 106, whereby an electrostatic latent image is formed on the photosensitive drum a. Yellow toner is supplied to the photosensitive drum a from the development device to develop the electrostatic latent image, and the electrostatic latent image is visualized as a yellow toner image (image). Accompanying the rotation of the photosensitive drum a, the toner image reaches a primary transfer portion at which the photosensitive drum a and the intermediate transfer belt 102 are abutted against each other. Then, the yellow toner image on the photosensitive drum a is transferred onto the intermediate transfer belt 102 by a primary transfer bias applied to the transfer charge member 102*a* (primary transfer).

When a portion of the intermediate transfer belt 102 carrying the yellow toner image moves to the image forming portion, a magenta toner image (image) is formed on the photosensitive drum b in the image forming portion in a similar manner to the above method until that time. Then, the magenta toner image is transferred onto the intermediate transfer belt 102 from above the yellow toner image. Similarly, as the intermediate transfer belt 102 moves, a cyan toner image and a black toner image are transferred onto the yellow and magenta toner images so as to superimpose on the yellow and magenta toner images in the respective primary transfer portions of the image forming portion.

The copying machine body 130 includes at its lower portion a sheet feeding cassette 104 storing sheets P. The sheets P stored in the sheet feeding cassette 104 are fed sheet by sheet by a pickup roller 108 disposed in the upper portion in a sheet feeding direction. The timing of the sheet P is adjusted by a registration roller 109 and then reaches a secondary transfer portion. When the sheet P reaches the secondary transfer portion, all the toner images of four colors on the intermediate transfer belt 102 are transferred together by a secondary transfer bias applied to a secondary transfer roller pair 103 (secondary transfer).

The sheet P transferred with the four color toner images is guided to a conveyance guide 120 to be conveyed to a fixing roller pair 105, and, thus, to be fixed by being heated and pressurized by the fixing roller pair 105, whereby toners of the respective colors are melted and mixed to obtain a full color print image fixed to the sheet P. After that, the sheet P is discharged outside the copying machine body 130 by a discharge roller pair 110 disposed downstream the fixing roller pair 105.

Figure 2:
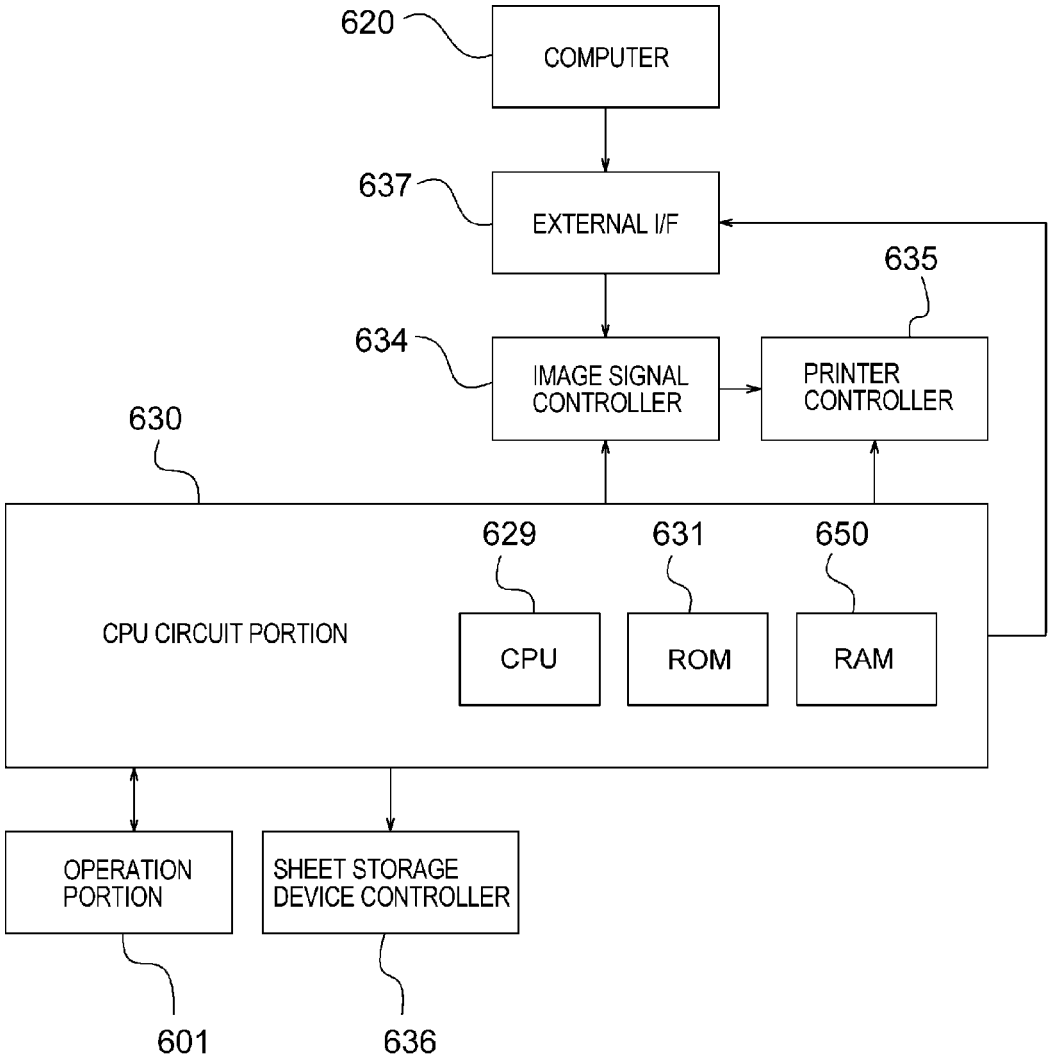
FIG. 2 is a block diagram illustrating a control system which controls a copying machine body and a sheet storage device according to the present invention.

FIG. 2 is a block diagram illustrating a control system which controls the copying machine body 130 and the sheet storage device 300 of the color copying machine 100. As shown in FIG. 2, the control system has a CPU circuit portion 630. The CPU circuit portion 630 has a CPU 629, a ROM 631, and a RAM 650.

The CPU circuit portion 630 controls an image signal controller 634, a printer controller 635, a sheet storage device controller (hereinafter referred to as a "storage device controller") 636, and an external interface 637. The CPU circuit portion 630 performs control in accordance with a program stored in the ROM 631 and setting of an operation portion 601. The operation portion 601 is disposed in the copying machine body 130, for example so that a user can perform a setting operation.

The printer controller 635 controls the copying machine body 130. The storage device controller 636 controls the sheet storage device 300. In the present embodiment, although the storage device controller 636 is mounted in the sheet storage device 300, the present invention is not limited to this constitution. Namely, the storage device controller 636 is provided in the copying machine body 130 integrally with the CPU circuit portion 630, and the sheet storage device 300 may be controlled from the copying machine body 130 side.

The RAM 650 is used as an area where control data is temporarily stored and a work area for calculation accompanying the control. The external interface 637 is an interface from a computer (PC) 620 and develops print data to an image to output the image to the image signal controller 634. The image output from the image signal controller 634 to the printer controller 635 is input to an exposure controlling portion (not shown).

Figure 3A:
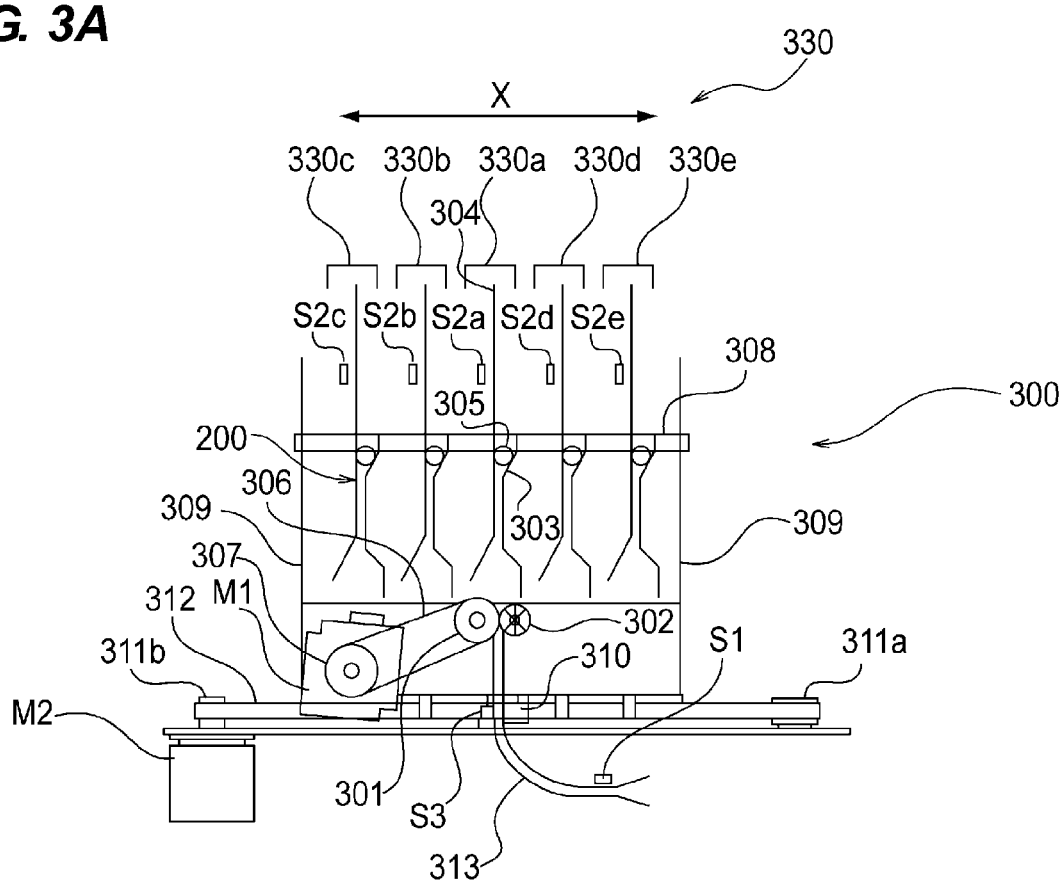
FIG. 3A is a cross-sectional view illustrating the sheet storage device in an embodiment according to the present invention.
Figure 3B:
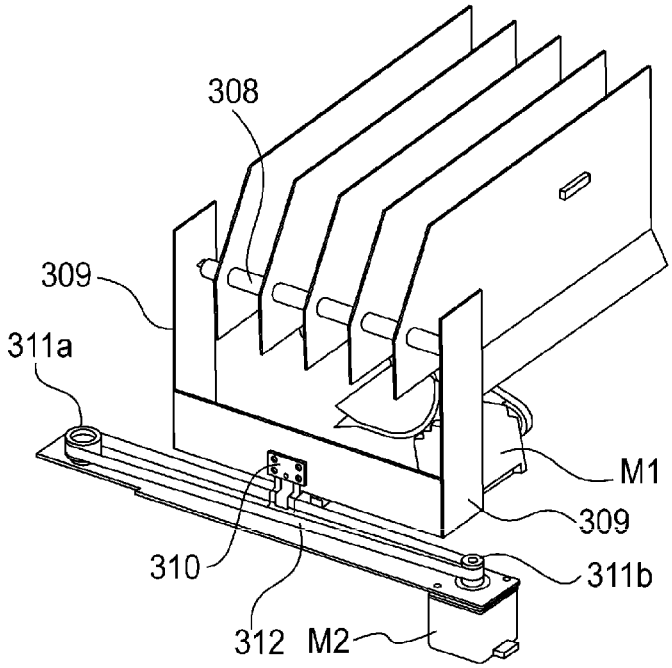
FIG. 3B is a perspective view illustrating the sheet storage device.
Figure 4A:
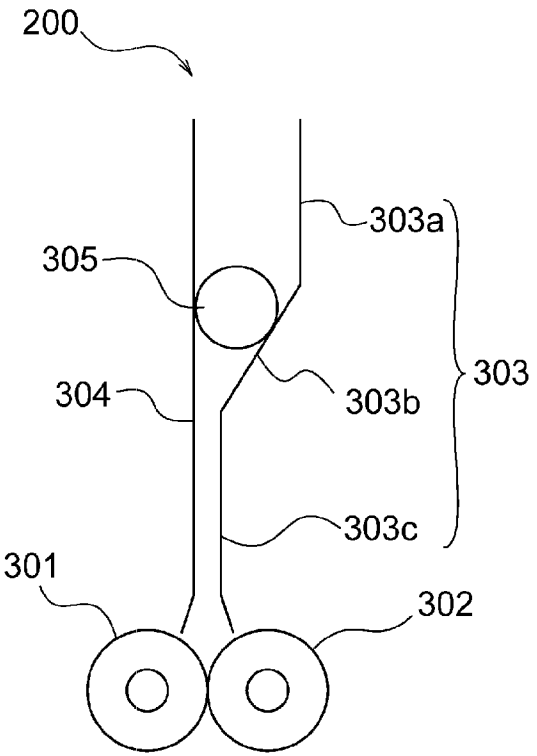
FIGS. 4A to 4C are cross-sectional views illustrating a detail of a holding portion of a sheet storage portion in the present embodiment.
Figure 4B:
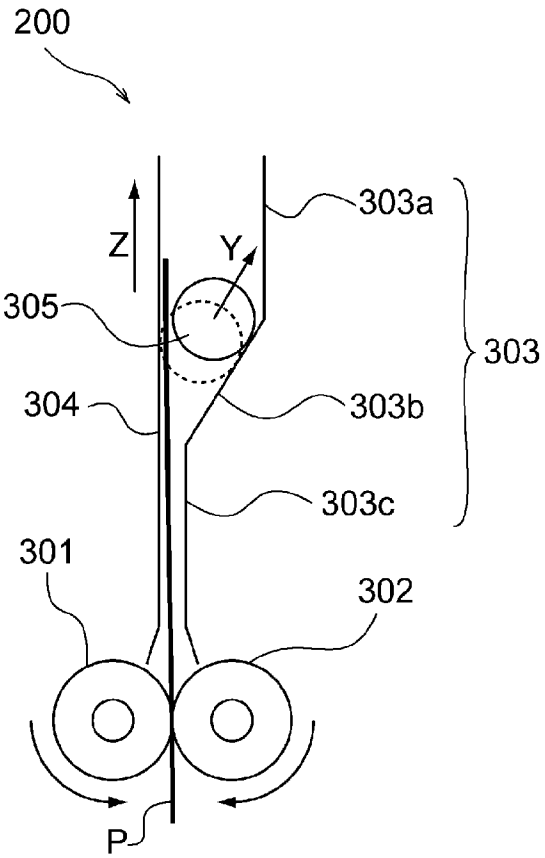
Figure 4C:
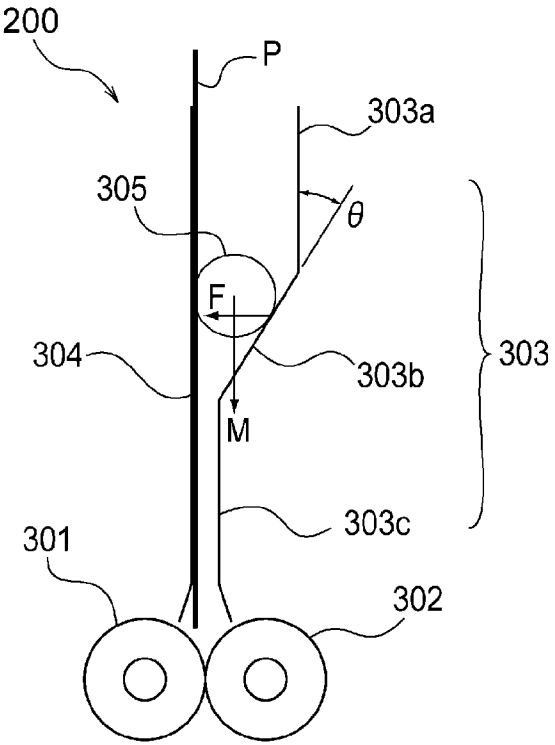

[Sheet storage device] First, the sheet storage device 300 will be described using FIGS. 1 and FIGS. 3 to 8. FIGS. 3A and 3B are a cross-sectional view and a perspective view of the sheet storage device 300 in the present embodiment respectively. FIGS. 4A to 4C are cross-sectional views illustrating a detail of a holding portion in the present embodiment.

The sheet storage device 300 is provided in the upper portion of the copying machine body 130 and equipped with a plurality of sheet storage portions 330*a* to 300*e* which stores the sheets conveyed in sequence from the copying machine body 130 and received from downward in such a state that the sheets stand. The sheet storage portions 330*a* to 300*e* are relatively rotatably supported in sequence and parallel by a common storage portion connecting shaft (supporting shaft) 308, and each sheet storage portion receiving the sheet from the copying machine body 130 is rotated to be held in the rotational position.

The sheet storage portions 330*a* to 330*e* each have a holding portion 200 which allows movement in the sheet conveying direction of the sheets received from the copying machine body 130, restricts movement of the sheet in a direction opposite to the sheet conveying direction, and holds the sheet. The sheet storage portions 330*a* to 330*e* are rotatably supported along a sheet surface of the sheet held by the holding portion 200 and, at the same time, supported in sequence and parallel in a direction that the sheet surfaces face each other. Namely, the sheet storage portions 330*a* to 330*e* are configured so that the sheet storage portions receiving the sheets and held by the holding portion 200 are rotated in sequence at different angles around the storage portion connecting shaft 308 as a fulcrum and held in the rotational positions.

The sheet storage portions 330*a* to 330*e* are configured so that each sheet storage portion receiving the sheet from the copying machine body 130 is rotated to an arbitrary rotational position and held in the rotational position. Namely, the sheet storage portions 330*a* to 330*e* are configured so that the sheet storage portions receiving the sheets and held by the holding portion 200 are rotated in sequence at different angles and held in the rotational positions.

Further, the sheet storage portions 330*a* to 330*e* are each configured so that a portion of the sheet passed through the holding portion 200 is held so as to protrude from the sheet storage portion. In FIG. 1, in the sheet storage portions 330*a* to 330*e*, a height of a storage guide plate 304 and a position of a holding member 305 are adjusted so that the front end (upper end in FIG. 1) of the sheet is held by the holding member 305 in the holding portion 200 so as to protrude from the sheet storage portion. This constitution can significantly contribute to enhancement of the sheet visibility and the sheet taking-out property in the sheet storage portions 330*a* to 330*e*.

Namely, as shown in FIGS. 1 and 3A, the sheet storage device 300 is disposed so as to be placed on the upper portion of the copying machine body 130. The sheet P is fed by the discharge roller pair 110 disposed in the copying machine body 130 through a curved conveyance guide 313 provided in the lower portion of the sheet storage device 300. An inlet sensor S1 is disposed at an inlet portion of the conveyance guide 313, and the timing of conveyance of the sheet P from the copying machine body 130 is monitored based on detection by the inlet sensor S1.

A conveying motor M1 and a conveying roller driving gear 307 transmitting drive of the conveying motor M1 are arranged downstream of the conveyance guide 313. Further, a conveying roller 301 to which rotation is transmitted from the conveying roller driving gear 307 through a conveying roller drive belt 306 and a conveyance follower roller 302 facing the conveying roller 301 are arranged. The conveying roller 301 and the conveyance follower roller 302 constitute a conveying roller pair (301 and 302) as a sheet conveying portion. The sheet P fed from the copying machine body 130 is conveyed to the sheet storage portions 330*a*, 330*b*, 330*c*, 330*d*, and 330*e* (hereinafter referred to as a "sheet storage portion 330" when the entire storage portion is described) by the conveying roller 301 and the conveyance follower roller 302.

As shown in FIG. 1, the sheet storage portions 330*a* to 330*e* are arranged in parallel in the width direction of the color copying machine 100 (horizontal direction in FIG. 1, that is, a direction that the sheet surfaces face each other). As shown in FIGS. 3A and 3B, the sheet storage portions 330*a* to 330*e* are connected to each other through the storage portion connecting shaft 308 extending in the width direction and a storage portion holding plate 309 having a generally substantially U-shape.

The sheet storage portions 330*a* to 330*e* receive drive from a storage portion moving motor M2, constituted of a pulse motor, through a movable connecting member 310 fixed to the central portion of a lower connecting portion of the storage portion holding plate 309, movable pulleys 311*a* and 311*b*, and a movable belt 312, whereby the sheet storage portions 330*a* to 330*e* can move integrally in an X direction (horizontal direction) of FIG. 3A through the storage portion holding plate 309. The movable belt 312 is an endless timing belt, and the movable pulleys 311*a* and 311*b* each have on their outer circumferences a tooth portion adapted to a pitch of a tooth portion of the movable belt (timing belt) 312.

A drive portion according to the present invention includes the storage portion moving motor M2, the movable pulleys 311*a* and 311*b*, and the movable belt 312. The drive portion moves the sheet storage portions 330*a* to 330*e* wholly relative to a sheet discharge portion of the copying machine body 130 so that the sheet storage portion selected from among these sheet storage portions can receive the sheet from the copying machine body 130. The sheet discharge portion corresponds to a nip of the conveying roller pair (301 and 302).

The conveying roller pair (301 and 302), the conveying motor M1, the storage portion moving motor M2, and the movable pulleys 311*a* and 311*b* are supported on the main body side of the sheet storage device 300. Meanwhile, the sheet storage portions 330*a* to 330*e* are supported so as to be movable in the horizontal direction. Accordingly, the sheet storage portions 330*a* to 330*e* move in the horizontal direction to change the relative position with the conveying roller pair (301 and 302), whereby the sheet P is conveyed into the sheet storage portions 330*a* to 330*e* and can be stored in the sheet storage portions 330*a* to 330*e* while being sorted.

A storage portion movement detection sensor S3 is positioned and fixed on the main body side of the sheet storage device 300 in a position corresponding to the lower central portion of the storage portion holding plate 309 in a home position in the horizontal direction shown in FIG. 3A. The storage portion movement detection sensor S3 detects the position of the movable connecting member 310 of the moving storage portion holding plate 309. The storage portion movement detection sensor S3 determines the receiving position of the sheet storage portions 330*a* to 330*e* by using the home position in the X direction (horizontal direction) in FIG. 3A of the sheet storage portions 330*a* to 330*e* and a driving pulse number of the storage portion moving motor M2 from the home position.

Sheet presence/absence detection sensors S2 (S2*a* to S2*e*) are arranged in the sheet storage portions 330*a* to 330*e*. The sheet presence/absence detection sensors (detecting portions)

S2*a* to S2*e* detect whether the sheet P is stored in the corresponding one of the sheet storage portions 330*a* to 330*e*. Based on the detection of the sheet absence, a CPU 701 (see, FIG. 8) of the storage device controller 636 determines that the next sheet P conveyed from the copying machine body 130 is conveyed into the sheet storage portion in which no sheet is stored.

Next, the holding portion 200 of the sheet storage portion 330 will be described using FIG. 3 and FIGS. 4A to 4C. Namely, as shown in FIG. 3A, the holding portions 200 are arranged in the sheet storage portions 330*a* to 330*e*, and the storage guide plate 304 and a conveyance guide 303 shown in FIGS. 4A to 4C are arranged in the holding portion 200.

The holding portion 200 is configured to, when there are subsequent sheets to be stored in the sheet storage portion having already received a sheet and held by the holding portion 200, receive the subsequent sheets in sequence so that the sheet storage portion is prevented from being rotated until one job is terminated. Namely, the storage guide plate 304 extending in a substantially perpendicular direction (vertical direction in the drawing) and the conveyance guide 303 extending in a substantially perpendicular direction (vertical direction in the drawing) so as to face the storage guide plate 304 are arranged in the holding portion 200. The conveyance guide 303 has a facing wall portion 303*a* facing and arranged at a predetermined interval relative to the storage guide plate 304 and a slope 303*b* inclined downward from a lower end of the facing wall portion 303*a* at a predetermined angle on the storage guide plate 304 side. The conveyance guide 303 has a conveyance guide portion 303*c* extending downward from the lower end of the slope 303*b* in parallel to the storage guide plate 304 and guiding a sheet.

Figure 5:
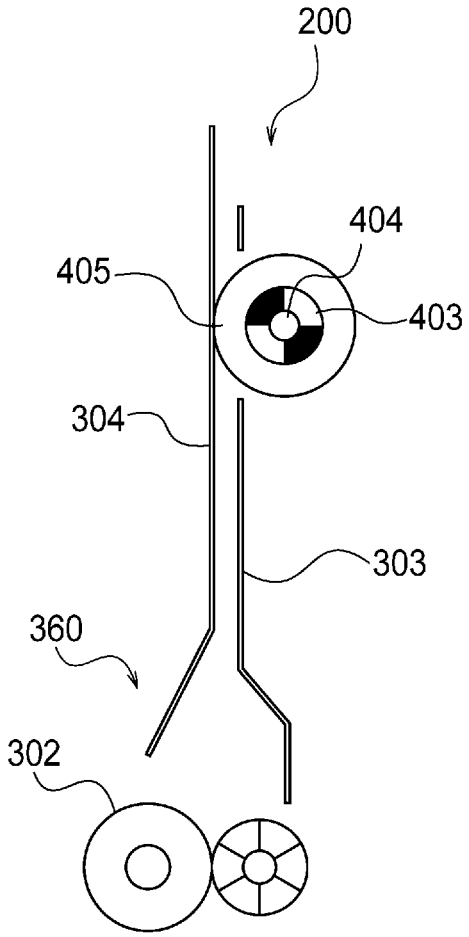
FIG. 5 is a view illustrating a configuration of another holding portion provided in the sheet storage device.

A holding member 305 is movably disposed so as to be in internal contact with the inner surfaces of the storage guide plate 304, the facing wall portion 303*a*, and the slope 303*b*. Although the holding member 305 can freely move in a direction that the guide-to-guide distance increases (upper direction in FIG. 4A), the holding member 305 cannot move in a direction that the guide-to-guide distance is reduced (lower direction in FIG. 4A). The conveyance guide 303 is provided with a retention member, which prevents the holding member 305 from being removed even if the holding member 305 moves from the near side to the depth side in FIG. 4, within a range that a conveying portion of the sheet P is not impeded. The holding member 305 used in the present embodiment may have any one of a ball shape, a cylindrical shape, and a spindle shape. As shown in FIG. 5, a fixing shaft 404 is fixedly provided at the conveyance guide 303, and a sponge roller 405 as a holding member may be provided around the fixing shaft through a one-way clutch 403. The sponge roller 405 is constituted of foam having an elasticity and is provided in a state of being elastically deformed by abutting against the storage guide plate 304. Although the one-way clutch 403 can be rotated freely in a clockwise direction in FIG. 5, the one-way clutch 403 cannot be rotated in the counter clockwise direction because it follows the fixing shaft 404. Namely, the sponge roller 405 incorporating the one-way clutch 403 is rotated following a sheet conveyed into the sheet storage portion 330 by the conveying roller 301 and the conveyance follower roller 302 as a sheet conveying portion. Meanwhile, the movement of a sheet in a direction opposite to the sheet conveying direction is limited by a pressing force of the sponge roller 405 generated between the storage guide plate 304 and the sponge roller 405, and the sheet is held against its own weight.

Subsequently, the operation that the sheet P is held by the holding portion 200 will be described using FIGS. 4B and 4C. Specifically, when the sheet P is conveyed into the holding portion 200 by the conveyance roller pair (301 and 302), the holding member 305 is moved by the thickness of the sheet P in an arrow Y direction (FIG. 4B). When the rear end of the sheet P is removed from the nip of the conveyance roller pair (301 and 302), the sheet P is held by the storage guide plate 304 and the holding member 305 (FIG. 4C).

As described above, when the sheet P is inserted between the storage guide plate 304 and the holding member 305, the sheet P can be inserted by a weak force that just moves the holding member 305, which is freely movable in the arrow Y direction, only by the thickness of the sheet P. When the rear end of the inserted sheet P is removed from the conveyance roller pair (301 and 302), gravity applied to the holding member 305 applies an abutting force F ($F=M/\tan\theta$) abutting against a surface of the storage guide plate 304 through the slope 303*b* of the conveyance guide 303 (FIG. 4C). By virtue of the abutting force F acting as the wedge effect, the sheet P is held in the holding portion 200 without being removed.

After that, the subsequent sheet P is conveyed between the storage guide plate 304 and the conveyance guide 303 as with the preceding held sheet P held by the inner surface of the storage guide plate 304 and then enters a nip between the holding member 305 and the preceding sheet P. According to this constitution, the subsequent sheet P is also held by the abutting force F while the preceding held sheet P is held in the storage guide plate 304.

The above series of operation is repeated with respect to the sheets P conveyed in sequence, whereby a plurality of the sheets P can be stored in the sheet storage portions 330*a* to 330*e*. When the sheet held between the storage guide plate 304 and the holding member 305 is drawn from the near side to the depth side of the sheet storage device 300 and in an arrow Z direction (the upper direction in FIG. 4B), the wedge effect is not acted, and therefore, the sheet (or a bundle of sheets) can be easily taken from the holding portion 200 in one hand.

Figure 6A:
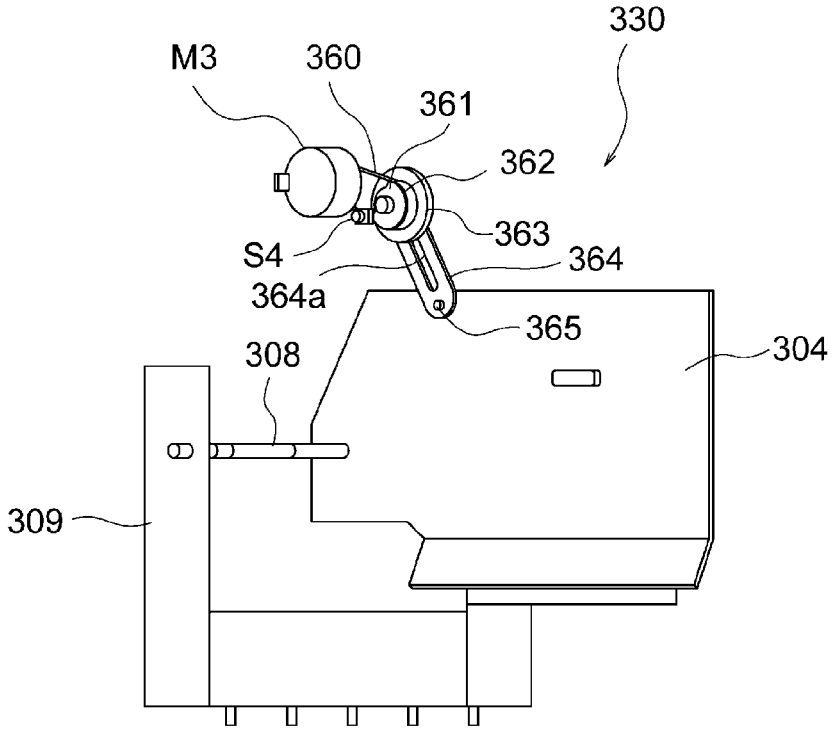
FIGS. 6A and 6B are perspective views for describing a rotational configuration of the sheet storage portion of the sheet storage device in the present embodiment.
Figure 6B:
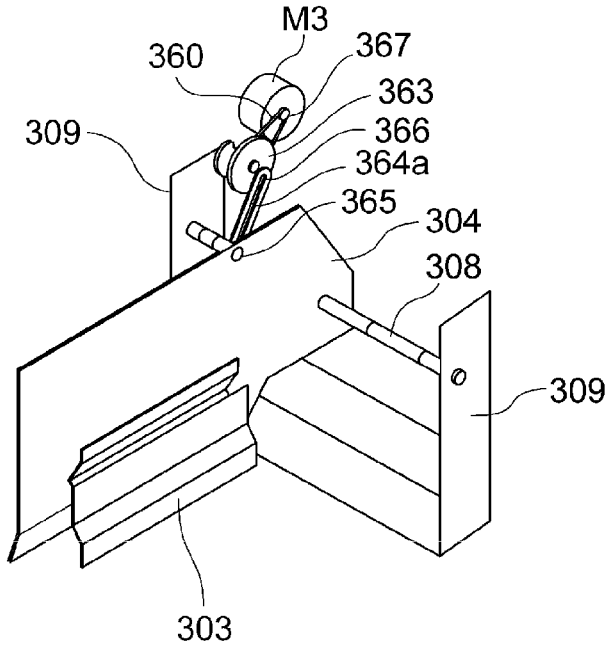

Next, the configuration for rotating the sheet storage portion 330 of the sheet storage device 300 according to the present invention will be described. FIGS. 6A and 6B are perspective views for describing a rotating configuration of the storage portion of the sheet storage device according to the present invention.

Namely, as shown in FIGS. 6A and 6B, the sheet storage portions 330 (330*a* to 330*e*) each have a storage portion rotation motor M3 arranged therein. Each of the storage portion rotation motors M3 is attached to the main body side of the sheet storage device 300.

A pulley 367 for rotating a storage portion is attached to an output shaft of the storage portion rotation motor M3. A pulley 362 for rotating a storage portion positioned on the main body side of the sheet storage device 300 is arranged on the storage portion holding plate 309 side at a distance from the pulley 367. An endless timing belt 360 is wound around between the pulleys 362 and 367. Accordingly, when the storage portion rotation motor M3 is rotated and driven, a rotating plate 363 is rotated through the pulleys 362 and 367 and the timing belt 360.

A link shaft 366 is fixed to a peripheral edge of the rotating plate 363 so as to protrude from a plate surface of the rotating plate 363. The link shaft 366 is rotatably engaged in a guide groove 364*a* formed in the longitudinal direction of the link 364. The lower end of the link 364 is rotatably connected to the upper end of the storage guide plate 304 of the sheet storage portion 330 through a connecting shaft 365.

A rotating sensor flag 361 is attached to a rotation shaft of the rotating plate 363 coaxially with the rotation shaft. A storage portion rotational position detection sensor S4 which detects the rotating sensor flag 361 to detect the rotational position of the sheet storage portion 330 is attached to the main body side of the sheet storage device 300. According to this constitution, the rotation direction of the sheet storage portion 330 is determined based on the home position in the rotation direction of the sheet storage portion 330 and a driving pulse number of the storage portion rotation motor M3 from the home position.

According to the above constitution, the sheet storage portion 330 can be rotated around a storage portion connecting shaft 308, and the rotation angle is precisely changed according to the driving pulse number of the storage portion rotation motor M3 constituted of a pulse motor. Namely, the sheet storage portions 330*a* to 330*e* are rotated in sequence at different angles according to the driving pulse number of the storage portion rotation motor M3 and held at the respective rotational positions while the sheets received in the sheet storage portions are held by the holding portion 200.

Figure 7A:
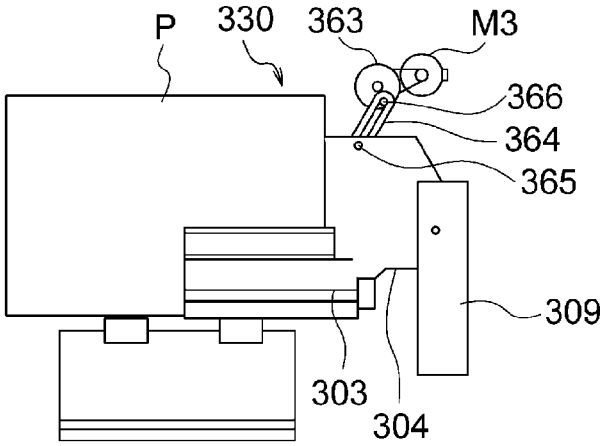
FIGS. 7A to 7C are side views for describing the rotational operation of the sheet storage portion of the sheet storage device in the present embodiment.
Figure 7B:
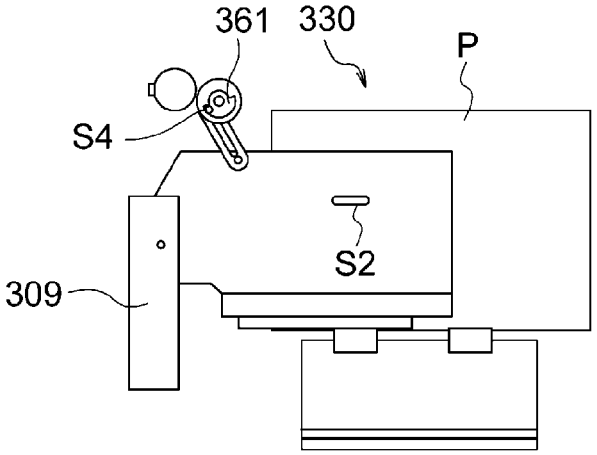
Figure 7C:
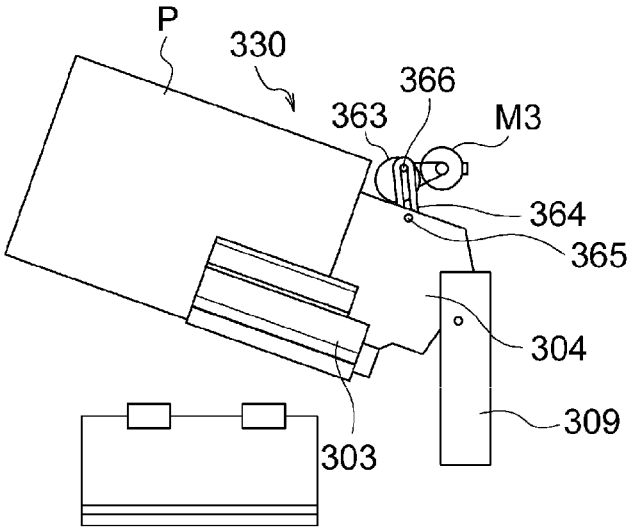

Next, the rotation operation of the sheet storage portion 330 will be described with reference to FIGS. 7A to 7C. FIG. 7 is a view for describing the rotation operation of the sheet storage portion of the sheet storage device of the present embodiment. FIG. 7A is a right side view illustrating a state before the rotation of the sheet storage portion. FIG. 7B is a left side view illustrating the state before the rotation of the sheet storage portion. FIG. 7C is a right side view illustrating the state before the rotation of the sheet storage portion.

As shown in FIG. 7A, the sheet P is stored in the sheet storage portion 330, and the sheet storage portion 330 holds the sheet P. Then, after a lapse of a predetermined time from when the sheet presence/absence detection sensor S2 of FIG. 7B is made on, the storage portion rotation motor M3 is activated to rotate the rotating plate 363. According to this constitution, the link shaft 366 attached to the rotating plate 363 is rotated and moved, and the link 364 is moved to the position shown in FIG. 7C (moved upward). Consequently, since the connecting shaft 365 connecting the lower end of the link 364 to the storage guide plate 304 pulls the storage guide plate 304 upward, the sheet storage portion 330 is rotated in a clockwise direction in FIG. 7C.

Figure 8:
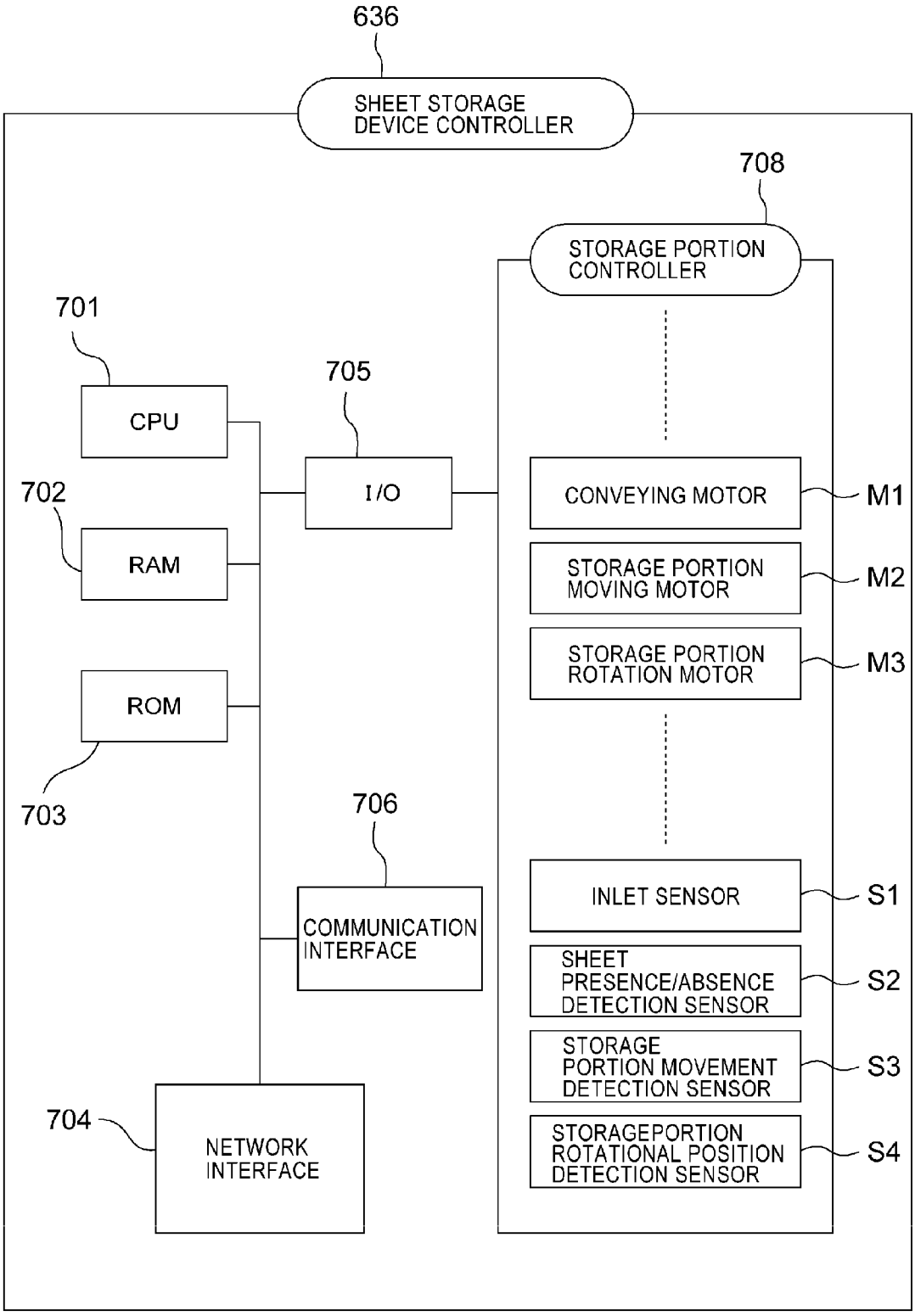
FIG. 8 is a block diagram illustrating a control system which controls the sheet storage device in the present embodiment.

Subsequently, a control system which controls the sheet storage device will be described with reference to FIG. 8. FIG. 8 is a block diagram illustrating the control system which controls the sheet storage device in the present embodiment.

Specifically, the storage device controller 636 is equipped with a CPU 701, a RAM 702, a ROM 703, an I/O 705 managing a storage portion controller 708, a network interface 704, a communication interface 706, a storage portion controller 708, and so on.

The storage portion controller 708 is equipped with the conveying motor M1, the storage portion moving motor M2, the storage portion rotation motor M3, the inlet sensor S1, a sheet presence/absence detection sensor S2, the storage portion movement detection sensor S3, the storage portion rotational position detection sensor S4. The storage device controller 636 controls the motors M1 to M3 based on the detection results of each of the sensors S1 to S4 and performs communication between the CPU circuit portion 630 and the CPU 701 provided in the copying machine body 130 to send and receive data.

Following the above, the operation in the present embodiment performed when the sheets P are stored in, for example, the sheet storage portions 330*a*, 330*b*, and 330*d* of the present embodiment will be described with reference to FIGS. 9A to 9F.

Figure 9A:
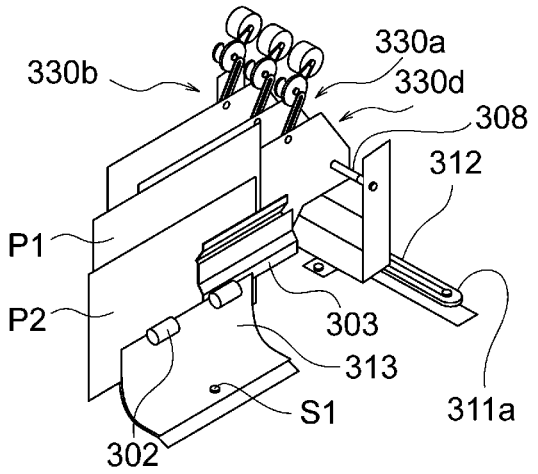
FIGS. 9A to 9F are perspective views for describing operation of the sheet storage device in the present embodiment.
Figure 9B:
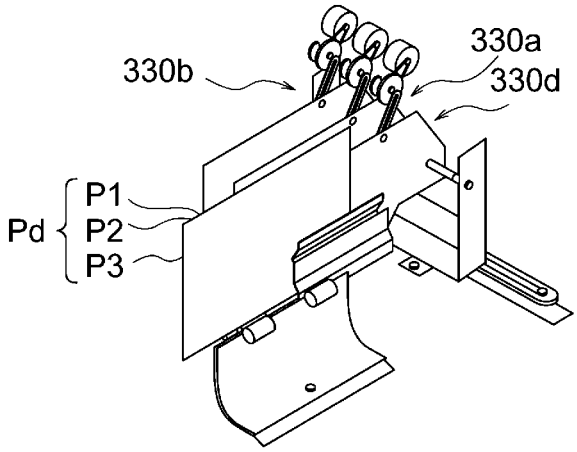

Specifically, as shown in FIG. 9A, while a sheet P1 is stored in the sheet storage portion 330*d* and held therein, a subsequent sheet P2 is sent to the sheet storage portion 330*d*, for example. Then, as shown in FIG. 9B, the sheets P2 and P3 are held in sequence in the sheet storage portion 330*d*, and it is regarded that one job is terminated once a sheet bundle Pd including the sheets P1 to P3 is formed.

Figure 9C:
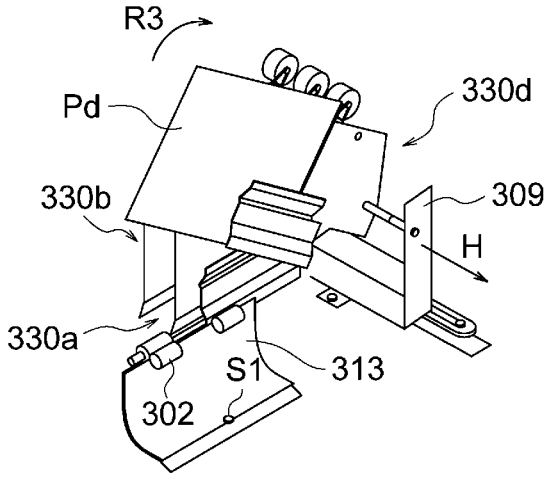

As shown in FIG. 9C, the sheet storage portion 330*d* is rotated upward just by an angle R3 around the storage portion connecting shaft 308 while holding the sheet bundle Pd. The rotation operation is terminated, and when a user selects a next job through an operation portion 601, the storage portion holding plate 309 starts to move in an arrow H direction (the same as the right direction of an arrow X in FIG. 3A). At this time, since the storage portion holding plate 309 and the sheet storage portions 330*a*, 330*b*, and 330*d* are united with each other, the sheet storage portions 330*a*, 330*b*, and 330*d* are integrally moved accompanying the movement of the storage portion holding plate 309.

Figure 9D:
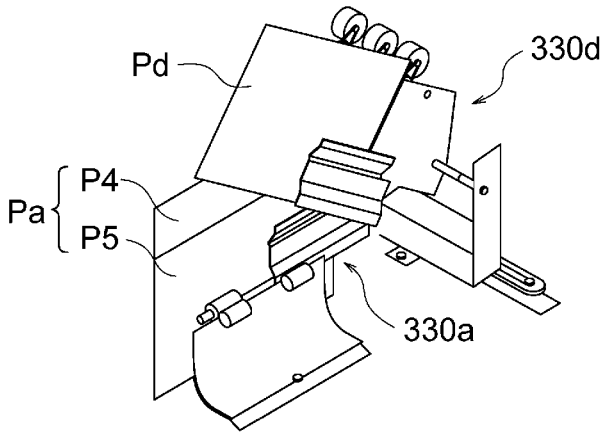

The sheet storage portion as a next storage destination is moved to a position facing the nip of the conveying roller pair (301 and 302), and the storage destination is determined. Namely, the above drive portion is controlled based on the detection of the storage portion movement detection sensor (detecting portion) S3, and selected one of the sheet storage portions 330*a* to 330*e* is located to face the nip (sheet discharge portion) of the conveying roller pair (301 and 302). At this time, for example when the sheet storage portion 330*a* is selected as the next storage destination, sheets P4 and P5 are stored in the sheet storage portion 330*a* and held in sequence as shown in FIG. 9D, and a sheet bundle Pa is formed to terminate the job.

Figure 9E:
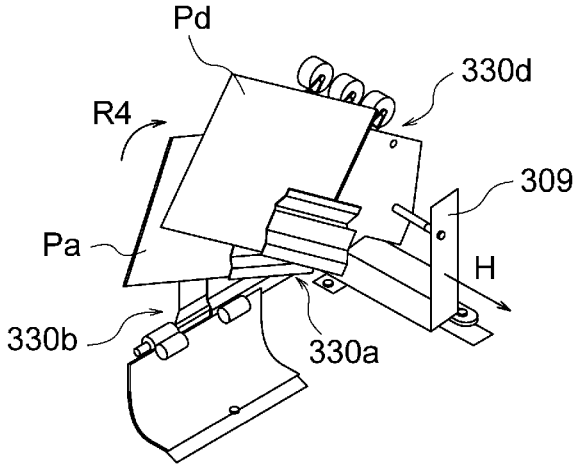

As shown in FIG. 9E, the sheet storage portion 330*a* rotates upward just by an angle R4 around the storage portion connecting shaft 308 of the storage portion holding plate 309 while holding the sheet bundle Pa. The storage device controller 636 controls the rotation angle R3 of the sheet storage portion 330*d* and the rotation angle R4 of the sheet storage portion 330*a* so that these angles are different from each other. According to this constitution, also when the plurality of sheet storage portions stores the sheet, the visibility can be enhanced, and a user can easily determine that a sheet output by the user is stored by which of the sheet storage portions.

Figure 9F:
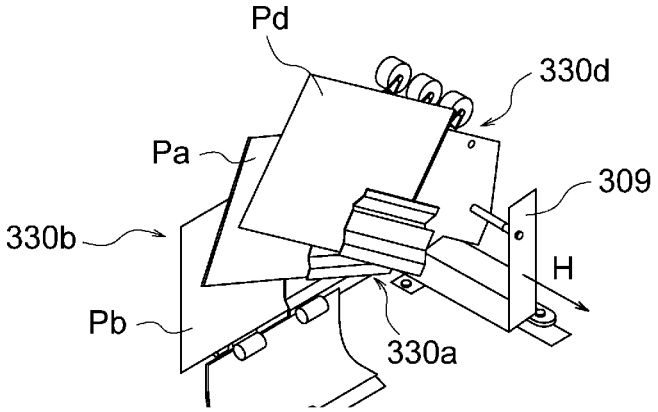

The next job is started, and for example when the sheet storage portion 330*b* is selected, the storage portion holding plate 309 is moved in the arrow H direction again as shown in FIG. 9E. Accompanying the movement, the sheet storage portions 330*a*, 330*b*, and 330*d* move to a position where a sheet is stored in the sheet storage portion 330*b*. Then, as shown in FIG. 9F, sheets are stored in sequence in the sheet storage portion 330*b*, and a sheet bundle Pb is formed.

In the present embodiment, although only the sheet storage portions 330*a*, 330*b*, and 330*d* have been described, it is obvious that the sheet storage portions 330*c* and 330*e* store a sheet in a similar way, and when a job is terminated, the sheet storage portions 330*c* and 330*e* are rotated.

As described above, when a sheet is stored in the sheet storage portion 330, the sheet storage portions 330*a* to 330*e* are rotated to be moved to a position for storing a sheet in other storage portions while keeping the rotation angle. The rotation angle of each of the sheet storage portions 330*a* to 330*e* is changed, whereby the visibility of a sheet stored in the sheet storage portion 330 is secured, and the sheet taking-out property for a user can be enhanced.

Next, an operation flow when the sheet P discharged from the copying machine body 130 is stored in the sheet storage device 300 will be described using flow charts of FIGS. 10 to 13.

Specifically, when a print job is sent to the color copying machine 100 (step 800), the operation flow proceeds to storage objective tray number determination processing (step 801).

Figure 11:
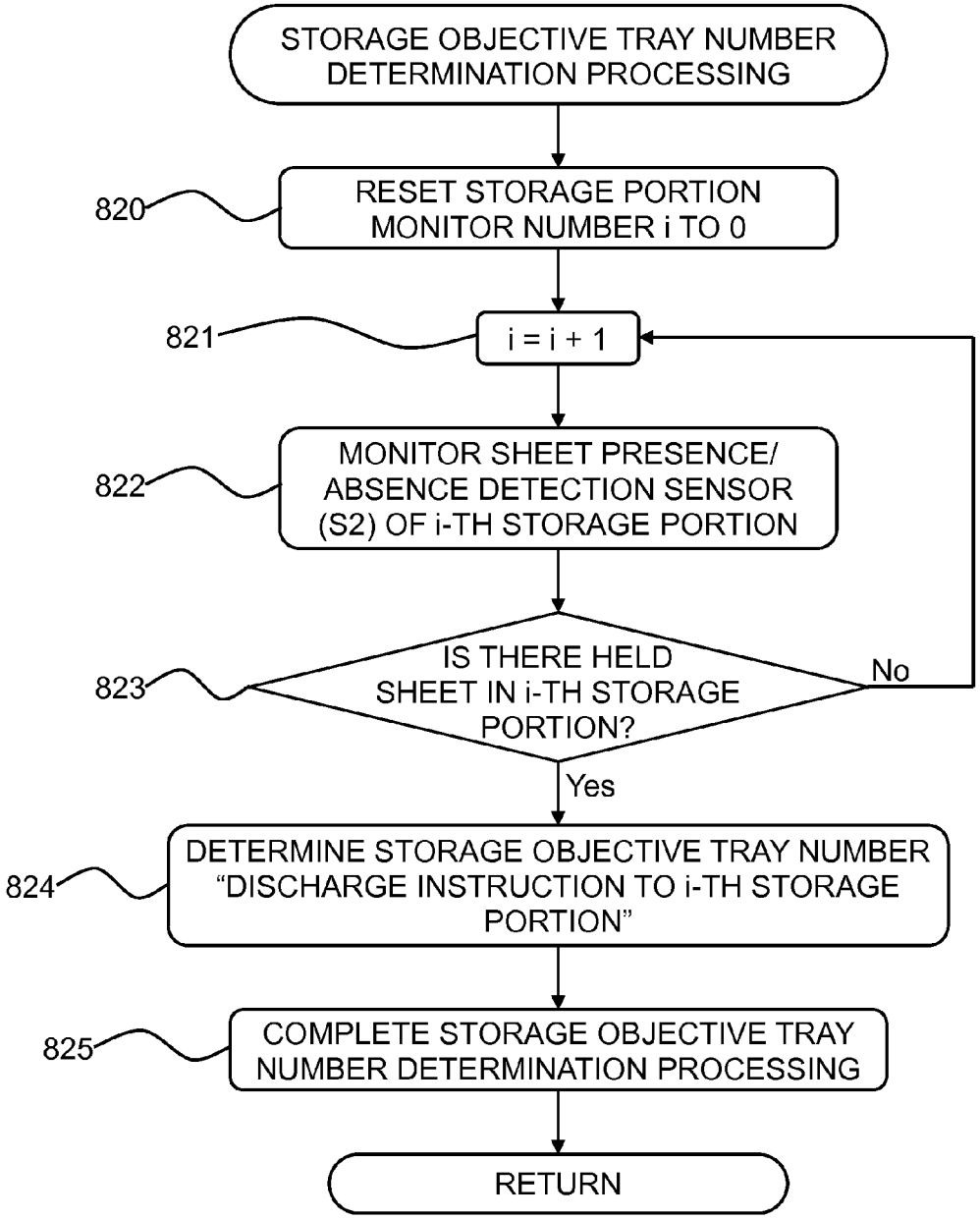
FIG. 11 is a flow chart for describing the operation of the present embodiment.

FIG. 11 is a flow chart illustrating a subroutine started at label of the "storage objective tray number determination processing". First of all, a storage portion monitor number i is reset to 0 (820), and then processing of adding 1 to the storage portion monitor number i is performed (821). Then, the sheet presence/absence detection sensor S2 in an i-th sheet storage portion is monitored, and whether a held sheet exists in the i-th sheet storage portion is discriminated (823).

When the held sheet exists in the i-th sheet storage portion, the operation flow is returned to step 821, and the processing of adding 1 to the storage portion monitor number i is performed again. When the held sheet exists in the sheet storage portion, the operation flow is repeated until monitoring of the fifth sheet storage portion is terminated.

If the monitoring of the fifth sheet storage portion is terminated, when the held sheet exists in the sheet storage portion, that is, when held sheets exist in all the sheet storage portions, a signal "stack FULL" is output from the CPU 701. Meanwhile, when no held sheet exists in the i-th sheet storage portion, the sheet storage portion to which a sheet is to be conveyed is determined to issue a conveyance instruction for conveying a sheet to the i-th sheet storage portion, and, thus, to complete the storage objective tray number determination processing (824 and 825), whereby the operation flow proceeds to storage portion movement processing (802) of FIG. 10.

Figure 12:
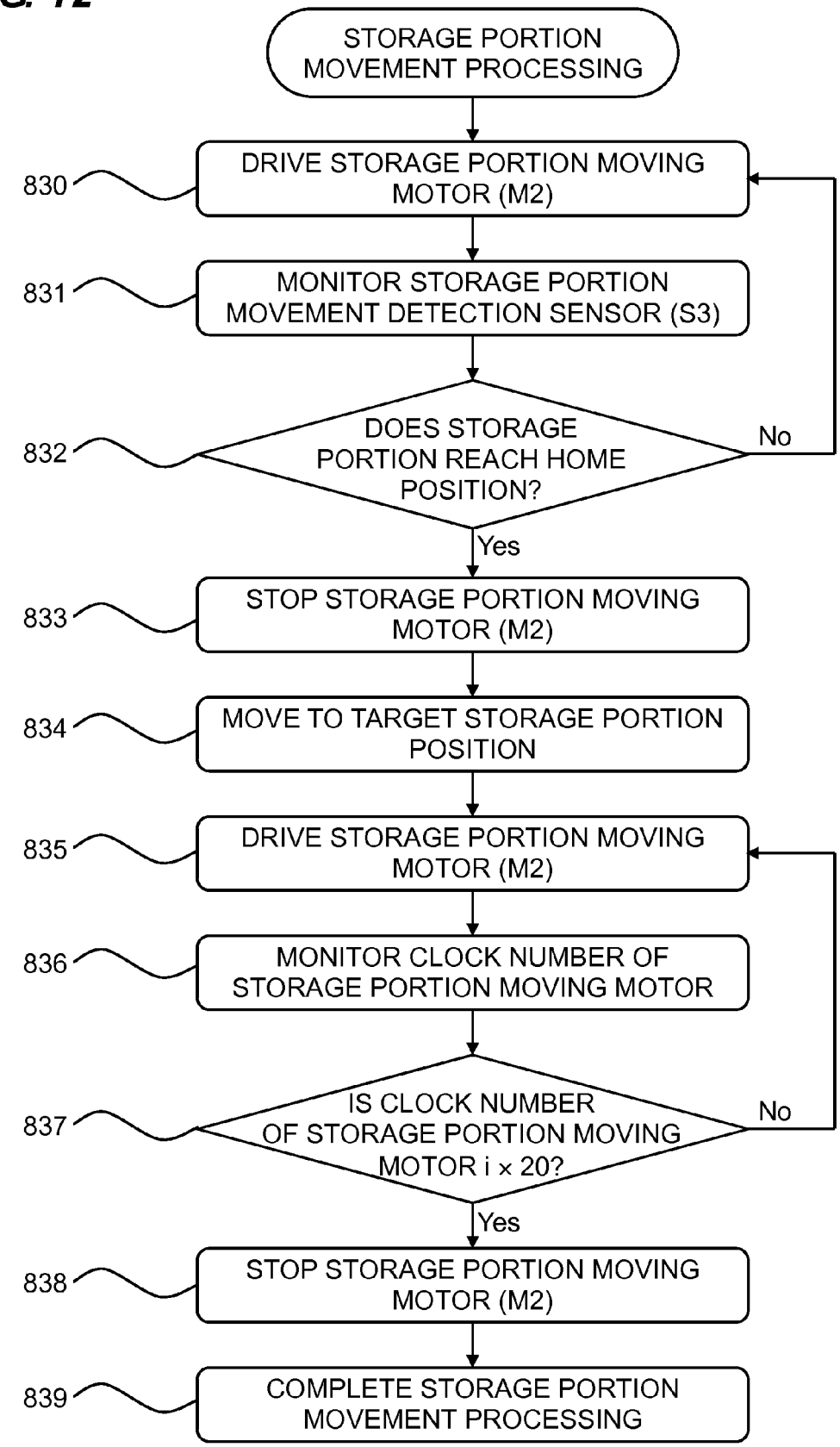
FIG. 12 is a flow chart for describing the operation of the present embodiment.

FIG. 12 is a flow chart illustrating a subroutine started at label of the "storage portion movement processing". First of all, the storage portion moving motor M2 is driven to be operated to a detecting position of the storage portion movement detection sensor S3, and the sheet storage portions 330*a* to 330*e* are temporarily moved to the home position in the horizontal direction (830, 831, and 832).

The clock number of the storage portion moving motor M2 is counted from the home position to a position where the i-th sheet storage portion determined by the storage objective tray number determination processing (801) corresponds to the conveying roller 301. Then, the sheet storage portions 330*a* to 330*e* are stopped at a predetermined position (834 to 839). Namely, the sheet storage portion is moved to a target sheet storage portion (834) to drive the storage portion moving motor M2 (835), and, thus, to monitor the clock number of the storage portion moving motor M2 (836). The storage portion moving motor M2 is driven until the clock number of the storage portion moving motor M2 is i×20 (837) to stop the storage portion moving motor M2 once the clock number is i×20 (838), and, thus, to complete the storage portion movement processing (839).

Figure 10:
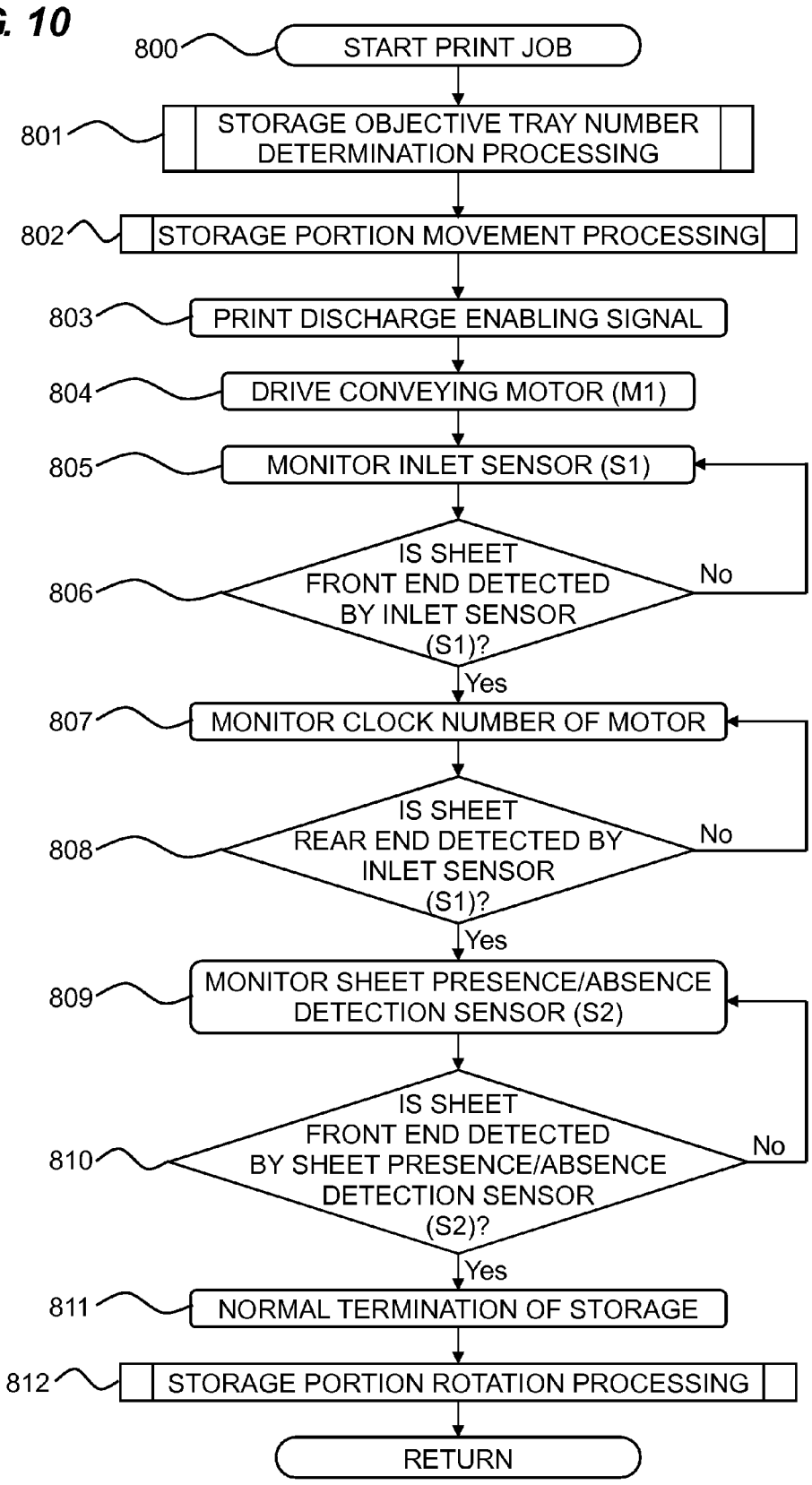
FIG. 10 is a flow chart for describing the operation of the present embodiment.

As shown in FIG. 10, when the storage portion movement processing (802) is completed, a print discharge enabling signal is output (803), and the conveying motor M1 of the sheet storage device 300 is driven (804). The arrival of a sheet is monitored by the inlet sensor S1 in preparation for the conveyance of a sheet from the copying machine body 130 (805).

A jam signal is output (805 to 810) in the following cases: (1) when a sheet front end does not reach the inlet sensor S1 in a predetermined timing; (2) when a sheet rear end detection signal according to the inlet sensor S1 is not obtained even if a predetermined motor clock number elapses from when the sheet front end is passed through the inlet sensor S1; and (3) when a detection signal according to the sheet presence/absence detection sensor S2 of each sheet storage portion is not obtained even if a predetermined motor clock number elapses from when the sheet front end is passed through the inlet sensor S1.

When the sheet presence/absence detection sensor S2 outputs a detection signal in a predetermined motor clock number, it is determined that a sheet is normally held by the holding portion 200 of the sheet storage portion 330, and it is determined that the print job is normally terminated (completed) (811). When the completion of the storage of the sheet is determined, the processing of rotating the sheet storage portion 330 is executed (812).

Figure 13:
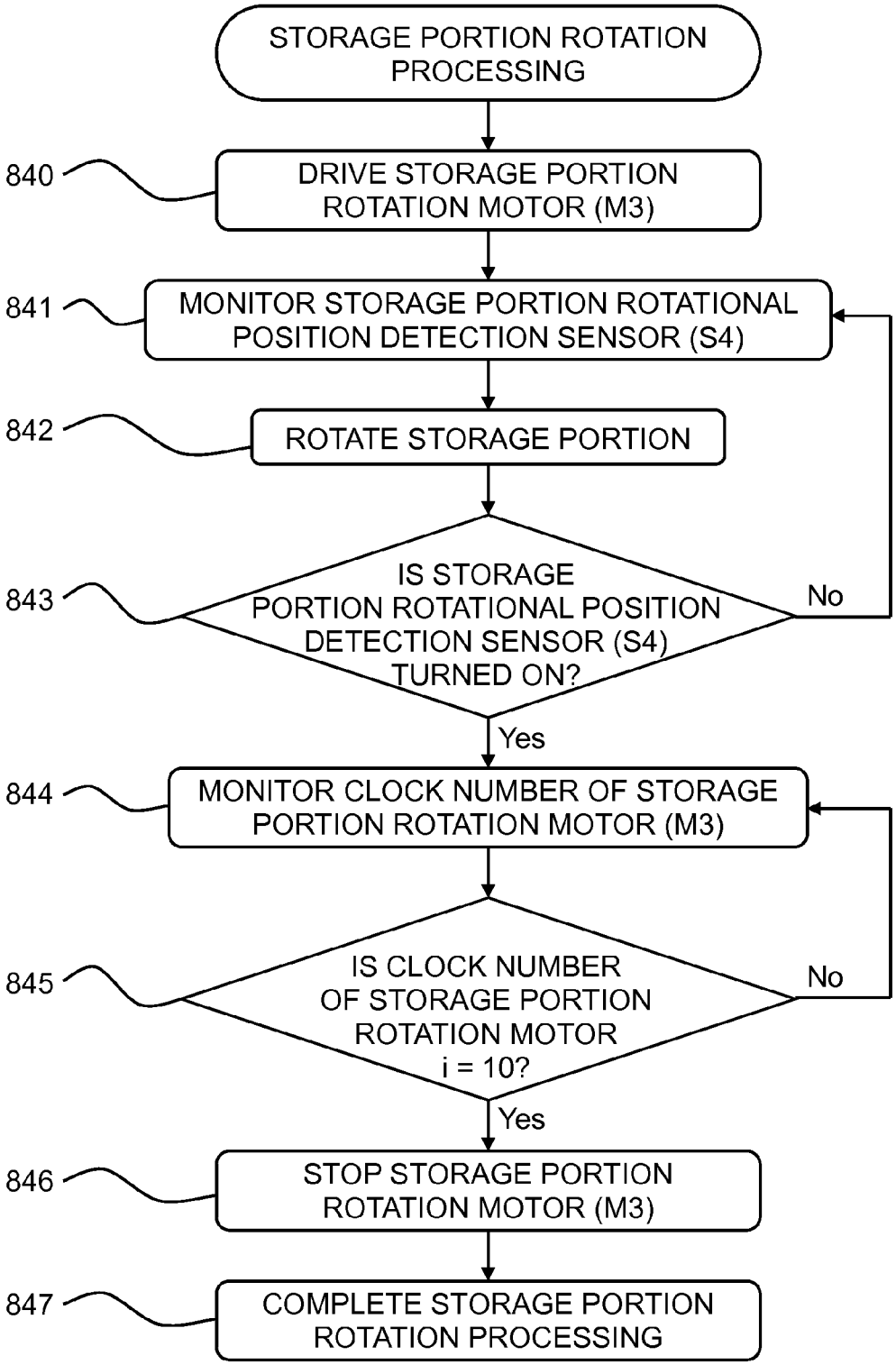
FIG. 13 is a flow chart for describing the operation of the present embodiment.

FIG. 13 is a flow chart illustrating a subroutine started at label of "storage portion rotation processing". First of all, the storage portion rotation motor M3 is driven (840), the storage portion rotational position detection sensor S4 detects the rotational position of the sheet storage portion 330 (841), and the sheet storage portion 330 starts to rotate (842).

The storage portion rotational position detection sensor S4 is made ON (843) to monitor the clock number of the storage portion rotation motor M3 (844). When the storage portion rotation motor M3 reaches a predetermined clock number (845) to stop the storage portion rotation motor M3 (846), and, thus, to complete the rotation processing of the sheet storage portion 330 (847). At this time, setting is performed so that the clock number of the storage portion rotation motor M3 is changed for each of the sheet storage portions 330 so that the rotation angle of the sheet storage portion 330 is changed for each of the sheet storage portions 330.

According to the present embodiment, there is no difference in height in the storage position, the visibility in any storage portion can be enhanced in comparison with a conventional device, and the sheet taking-out property can be enhanced. Since the sheet storage portions 330*a* to 330*e* are arranged in parallel in the upper portion of the color copying machine 100, the sheet storage amount can be increased without increasing the installation space of the device (length in horizontal width direction) in comparison with a conventional device. In the storage method in the sheet storage portions 330*a* to 330*e*, since the method of storing sheets in the vertical direction is used, the device installation space (length in horizontal width direction) is not increased even if a large-size sheet portion is stored.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-133568, filed Jun. 15, 2011, which is hereby incorporated by reference herein in its entirety.

What is claimed is:

1. A sheet storage device comprising:

a sheet conveying portion which conveys a sheet; and a plurality of sheet storage portions which receive the sheet conveyed from below to above and stores the received sheet in a vertical state, the sheet storage portions each having a storage guide portion provided in a vertical state which guides the sheet conveyed by the sheet conveying portion from below to above;

a holding portion which holds a sheet in cooperation with a guide surface of the storage guide portion so as to allow movement in a sheet conveying direction of the sheet and so as to restrict movement of the sheet in a direction opposite to the sheet conveying direction;

a supporting portion which rotatably supports the sheet storage portion around an axis arranged in a perpendicular direction to the guide surface of the storage guide portion; and a driving unit which rotates the sheet storage portion around the axis.

2. The sheet storage device according to claim 1, further comprising a controller which controls each of the driving units of the plurality of sheet storage portions so that the plurality of sheet storage portions are rotatable to any rotational position respectively.

3. The sheet storage device according to claim 2, wherein the plurality of sheet storage portions are capable of being held in rotational positions to which the sheet storage portions are rotated at different angles.

4. The sheet storage device according to claim 2, wherein the sheets are received in sequence so that the sheet storage portion is not rotated until one job is terminated.

5. The sheet storage device according to claim 1, wherein the plurality of sheet storage portions further includes a detecting portion which detects the presence/absence of the sheet, and a drive portion which moves the plurality of sheet storage portions wholly relative to the sheet conveying portion so that the sheet storage portion selected, based on detection of the absence of the sheet by the detecting portion, from among the plurality of sheet storage portions is allowed to receive the sheet from the sheet conveying portion, wherein the selected sheet storage portion is moved to face the sheet conveying portion by the drive portion.

6. The sheet storage device according to claim 1, wherein the holding portion holds the sheet so that a portion of the sheet passed through the holding portion protrudes from an end of the sheet storage portion.

7. An image forming apparatus comprising:

an image forming portion which forms an image;

a sheet conveying portion which conveys a sheet formed with an image; and a plurality of sheet storage portions which receive the sheet conveyed from below to above and stores the received sheet in a vertical state, the sheet storage portions each having a storage guide portion provided in a vertical state which guides the sheet conveyed by the sheet conveying portion from below to above;

a holding portion which holds a sheet in cooperation with a guide surface of the storage guide portion so as to allow movement in a sheet conveying direction of the sheet and so as to restrict movement of the sheet in a direction opposite to the sheet conveying direction;

a supporting portion which rotatably supports the sheet storage portion around an axis arranged in a perpendicular direction to the guide surface of the storage guide portion; and a driving unit which rotates the sheet storage portion around the axis.

8. The image forming apparatus according to claim 7, further comprising a controller which controls each of the driving units of the plurality of sheet storage portions so that the plurality of sheet storage portions are rotatable to any rotational position respectively.

9. The image forming apparatus according to claim 8, wherein the plurality of sheet storage portions are capable of being held in rotational positions to which the sheet storage portions are rotated at different angles.

10. The image forming apparatus according to claim 8, wherein the sheets are received in sequence so that the sheet storage portion is not rotated until one job is terminated.

11. The image forming apparatus according to claim 7, wherein each of the plurality of sheet storage portions further includes a detecting portion which detects the presence/absence of the sheet, and a drive portion which moves the plurality of sheet storage portions wholly relative to the sheet conveying portion so that the sheet storage portion selected, based on detection of the absence of the sheet by the detecting portion, from among the plurality of sheet storage portions is allowed to receive the sheet from the sheet conveying portion, wherein the selected sheet storage portion is moved to face the sheet conveying portion by the drive portion.

12. The image forming apparatus according to claim 7, wherein the holding portion holds the sheet so that a portion of the sheet passed through the holding portion protrudes from an end of the sheet storage portion.

* * * * *